United States Patent [19]

van Os

[11] Patent Number: 4,515,536

[45] Date of Patent: May 7, 1985

[54] PERSTALTIC PUMP

[75] Inventor: Cornelis J. van Os, Emmen, Netherlands

[73] Assignee: Noord-Nederlandsche Machinefabriek B.V., Winschoten, Netherlands

[21] Appl. No.: 518,747

[22] Filed: Jul. 28, 1983

Related U.S. Application Data

[63] Continuation-in-part of Ser. No. 167,354, Jul. 10, 1980, Pat. No. 4,424,009.

[51] Int. Cl.[3] ..... F04B 43/10; F04B 43/12

[52] U.S. Cl. ..... 417/394; 417/474; 138/45; 138/119

[58] Field of Search ..... 417/394, 474, 478, 479; 138/45, 119

[56] References Cited

U.S. PATENT DOCUMENTS

| | | | |
|---|---|---|---|
| 3,039,309 | 6/1962 | Vesper et al. | 417/394 X |
| 3,406,633 | 10/1968 | Schomburg | 417/394 |
| 4,250,872 | 2/1981 | Tamari | 417/394 X |

*Primary Examiner*—Richard E. Gluck

*Attorney, Agent, or Firm*—Irvin A. Lavine

[57] ABSTRACT

A peristalitic pump comprising a pump housing accommodating a hose. A hollow space surrounding the hose is provided between the outer wall of the hose and the pump housing. The ends of the hose are sealingly attached all around to corresponding supply and discharge ends of the pump housing. The pump housing is provided with connecting tubes for supplying a pressure medium to the hollow space and discharging the medium therefrom, in order to exert pressure at desired points of time on the outer wall of the hose. The hose has an elliptic cross-sectional form adjacent the supply end along a given trajectory. Starting from the supply end, which is circular in cross-section, the hose becomes gradually flatter and broader to give a minimal value and sequentially in the direction of the hose portion extending toward the discharge end become increasingly less flat and broad in the same manner until the circular cross-section is obtained. The hose has a constant wall thickness along the entire length between the supply end and the discharge end and a constant inner circumferential length of the cross-section.

8 Claims, 14 Drawing Figures

A B C D D C B A
A B C D D C B A
A B C D D C B A
A B C D D C B A
1
2
3
4
5
6
7
8
9
10
11
12
13
14
I
II
III

PERSTALTIC PUMP

FIELD OF THE INVENTION

This is a continuation-in-part application of U.S. application Ser. No. 167,354 filed on July 10, 1980 now U.S. Pat. No. 4,424,009. The invention relates to a peristaltic pump comprising a pump housing and a hose disposed within the housing, the outer wall of the hose and the pump housing defining a hollow space surrounding the hose. The supply and discharge ends of the hose are sealingly connected all around to the corresponding supply and discharge ends of the pump housing. The pump housing includes means for supplying a pressure medium to the hollow space and for discharging the medium from the hollow space in order to exert pressure on the outer wall of the hose at desired points of time.

BACKGROUND OF THE INVENTION

A known peristaltic pump is described in U.S. Pat. No. 3,406,633. The known pump is based on the principle that the hose is squeezed by the medium supplied to the hollow space, so that the pumpable material present in the hose is urged from the hose.

In order to ensure that the compression of the hose starts at the proper place, so that the pumpable material is forced in the proper direction, the hose in the known pump is designed in such a way that the wall thickness of the hose increases from the supply end to the discharge end.

A drawback of this known pump is that the required hose is difficult to manufacture. Another drawback is that the hose in the known pump has already been squeezed considerably along the entire length before the hose walls contact each other at a point. Since the pumping action in the proper direction is not initiated until the hose has been entirely squeezed at least locally, the efficiency of the known pump is very low.

Furthermore a separate check device is necessary in the known pump, which results in damage to particles present in the pumpable material. For example, where blood is pumped, the blood platelets could be damaged, which is highly undesirable.

OBJECTS OF THE INVENTION

It is an object of the invention to provide a peristaltic pump which can be manufactured in a simple manner and in which the hose is first entirely or substantially entirely squeezed in a predetermined place before the rest of the hose is squeezed.

It is another object of the invention to provide a peristaltic pump comprising a special check device, the operation of which is based on the same principle as the operation of the pump proper, and which does not result in damage to the particles present in the pumpable material.

SUMMARY OF THE INVENTION

These and other objects of the present invention are achieved by a pump of the above described type wherein the hose adjacent the supply end has an elliptic cross-sectional shape over a portion thereof which, starting from the circular cross-section adjacent the supply end, becomes gradually flatter and wider to a given minimal value and subsequently, in the direction extending towards the discharge end of the hose portion, becomes increasingly less flat and broad until the cross-section again becomes circular.

BRIEF DESCRIPTION OF THE DRAWINGS

Some embodiments of the invention will now be described, by way of example, with reference to the accompanying drawings, in which.

DESCRIPTION OF THE PREFERRED EMBODIMENTS

Figures 1, 2, 3, 4A, 4B, 4C, 4D:
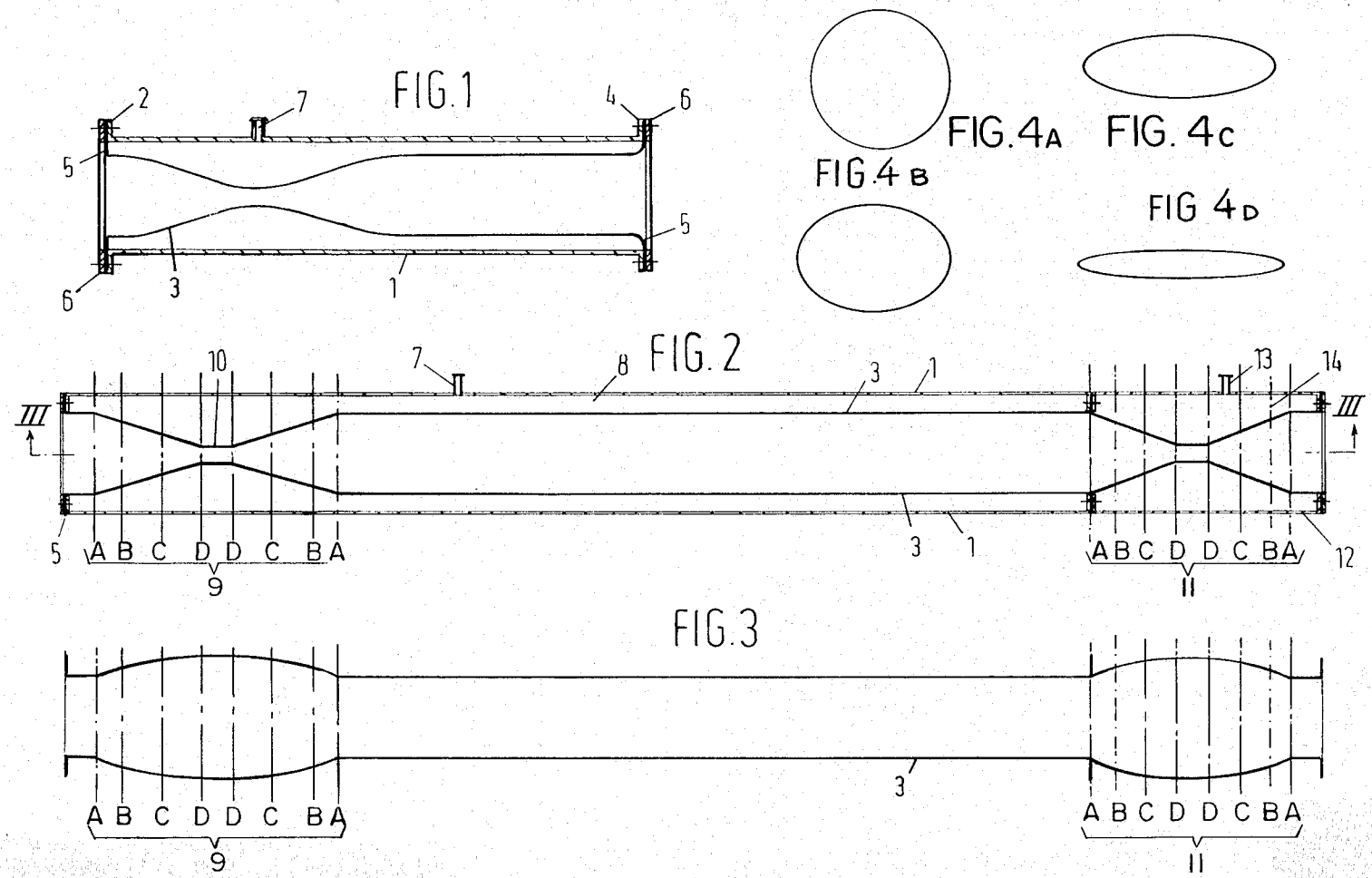
FIG. 1 is a diagrammatic view of a pump according to the invention.
FIG. 2 is a diagrammatic view of a pump according to the invention provided with a check device according to the invention.
FIG. 3 is a cross-section of the hose taken along line III—III of FIG. 2.
FIGS. 4*a*–4*d* show respectively cross-sections of a part of the hose taken along lines A, B, C, and D of FIGS. 2 and 3.

The pump shown in FIG. 1 comprises a pump housing 1 which is cylindrical and may be made of metal, glass or a suitable synthetic plastic material. The pump housing is provided at the supply end with a mounting flange 2 for a pump hose 3. A similar mounting flange 4 is present at the discharge end.

A pump hose to be described is disposed in the pump housing and comprises annular end collars 5, which are clamped against the flanges of the pump housing by means of clamping rings 6. To this end the clamping rings may be attached by means of bolts against the end flanges of the pump housing. Naturally, other attachment methods are possible also.

The hose 3 has a constant wall thickness and a constant cross-sectional circumference along its entire length.

The pump housing comprises a connecting tube 7 for a line, not shown, for supplying at desired points in time a pressure medium to the hollow space 8 between the pump housing and the outer wall of the hose. Said pressure medium may be a suitable gas or a suitable liquid.

When a pressure medium is supplied via the connecting tube 7 to the space 8, the hose is squeezed, so that the pumpable material present in the hose is forced out of the hose. If no special steps are taken, the hose will first be squeezed approximately midway in its length and equal amounts of pumpable material will be pressed to the supply end and the discharge end.

It is desirable for the hose to be entirely squeezed adjacent the supply end, so that substantially all of the pumpable material is pressed to the dicharge end. To ensure that the hose will be entirely squeezed first adjacent the supply end, the hose according to the invention has a portion 8 adjacent the supply end which has a special shape. This shape is obtained without weakening the hose.

Furthermore, this shaped is chosen in such a way that, during squeezing, only very small tensile stresses will occur in the hose material.

To this end, the cross-section of the hose, seen from the supply end in the direction of the discharge end, is first circular, then elliptic. The elliptic form becomes increasingly flatter as far as the place indicated at 10, and progressively becomes less flat until beyond specially shaped portion 9, the hose again has a circular cross-section. This is further indicated in FIGS. *4a–4d* which show respectively cross-sections A–D of the hose shown in FIGS. 2 and 3.

In this manner there is formed a "weak spot" where the hose closes first when a pressure medium is supplied to the hollow space 8. This "weak spot", however is a weak spot only in the sense that at the "weak spot", the resistance against squeezing is slight. The "weak spot", however, is not a weak spot in the hose, since the wall thickness of the hose at that location is not reduced.

Since the inner cross-sectional circumference of the hose is constant, only slight tensile stresses occur in the hose wall during squeezing of the hose adjacent the "weak spot", so that long life is ensured. Furthermore, this feature minimizes the impediment to the flow of material through the hose resulting from the weak spot.

A hose having a cross-sectional configuration as described above can be formed in a simple manner on a correspondingly formed core and can be seamless. A seamless hose enhances proper operation of the pump. Because the cross-section of the hose has a constant inner circumference, the core can easily be drawn from the hose formed thereon.

According to a further feature of the invention there is provided at the discharge end of the hose a specially formed hose portion 11 functioning as a check device.

This portion 11 can be integral with the hose 3, as shown in FIG. 3, but can also comprise a separate hose portion which links up with the discharge end of the hose 3.

In both cases the portion 11 is disposed in a separate housing portion 12 comprising a supply tube 13 for supplying pressure medium to a hollow space 14 between the housing portion 12 and the hose portion 11.

The hose portion 11, as shown in FIGS. 2 and 3, can have the same shape as the portion 9 of the hose 3, but can also have a cross-section corresponding to the cross-section of the line to be connected to the pump.

As with the rest of hose 3, the wall thickness of the hose portion 11 is uniform along the entire length and the cross-sectional circumference is constant.

When the hose portion 11 is integral with the hose 3, it is necessary to apply a collar to the hose at the transition between the hose 3 and the hose portion 11, to actuate separately pump hose 3 and the hose portion 11. The collar is clamped between corresponding flanges formed in the pump housing 1 and the housing portion 12.

When the hose portion 11 is not integral with the hose 3, the hose portion 11 is provided at both ends with collars of its own that are adapted to be clamped.

The operation of the pump shown in FIGS. 2 and 3 is as follows. As soon as the hose 3 is filled with the pumpable material, a pressure medium is supplied to the hollow space 8 via the connecting tube 7. The hose 3 is thereby first squeezed at 10, so that subsequent squeezing of the rest of the hose is initiated. This squeezing takes place gradually from the portion 10 towards the discharge end of the hose. As a result the pumpable material is pressed via the portion 11, which is open at that moment and functioning as a check device, to a delivery line (not shown) connected to the free end of the portion 11.

As soon as the hose 3 is entirely squeezed, the pressure medium is supplied to the hollow space 14, so that the portion 11 is squeezed as well. Immediately thereafter the pressure medium is discharged from the hollow space 8, so that the hose 3 assumes its original shape and refills with the pumpable material. The hose 3 is then squeezed again, at least at the weak spot. The weak spot is squeezed entirely or substantially entirely, so that the portion 11 is opened. Finally, the pressure medium is discharged from the hollow space 14 and the above described cycle starts again.

It is observed that various modifications of the above described pump are possible.

Figure 5:
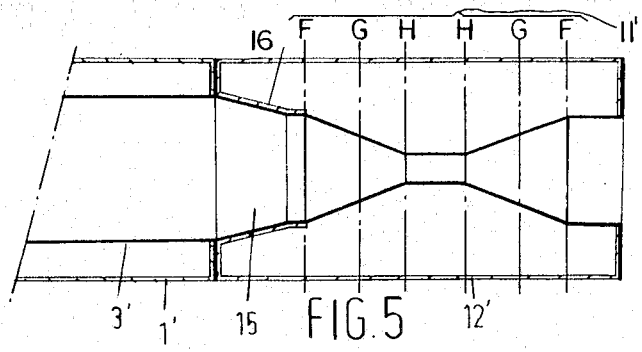
FIGS. 5, 6 and 7*f*–7*h* illustrate a first modification of the invention.
Figure 6:
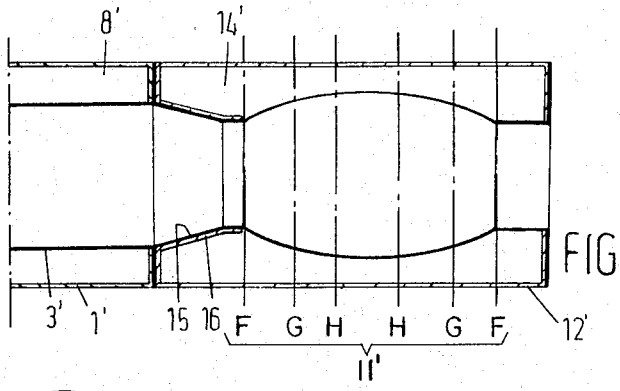
Figure 7H:
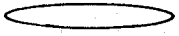
Figure 7G:
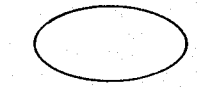
Figure 7F:
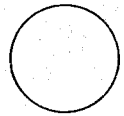

For instance, the cross-section of the check device 11 can correspond to the cross-section of the delivery line to be coupled to the pump. Such an embodiment is diagrammatically shown in FIGS. 5, 6 and *7f–7h*. FIGS. 5 and 6 diagrammatically show the discharge portion of a pump according to the invention similar to FIGS. 2 and 3. Corresponding portions are indicated by the same reference numerals provided with an accent. Various cross-sections F–H of the check device 11 are shown in FIGS. *7f–7h*. The dimensions of the cross-sections are smaller than the dimensions of the corresponding cross-sections of FIGS. 2 and 3.

In order to obtain a smooth transition between the pump hose 3 and the check device 11, there is formed in the check device 11 a conical portion 15 having a circular cross-section throughout. This conical portion 15 can be supported by and attached to a correspondingly formed flange 16 in the housing portion 12.

Furthermore, it is possible to fill the hollow space 14 or 14' once with a pre-compressed gas under a given pressure. This pre-compression should be such that the portion 11 or 11' is normally squeezed, but opens as soon as pressure is exerted by the hose 3 on the pumpable material, so that the pumpable material is forced to the portion 11 or 11'.

Separate control of the pressure in the hollow space 14 or 14' via the supply and discharge of the pressure medium is not necessary in that case.

Although the figures show the check device 11 or 11' as being connected to the pump hose 3, it is also possible to apply the check device around the discharge end of the pump hose. The check device in this case will have a configuration similar to the configuration of check device 11 shown in FIGS. 2 and 3 and check device 11' shown in FIGS. 5 and 6. This configuration is necessary to ensure that the end portion of the hose 3 which is to be squeezed by the check device is squeezed in the same direction as the rest of the hose 3.

Figure 8:
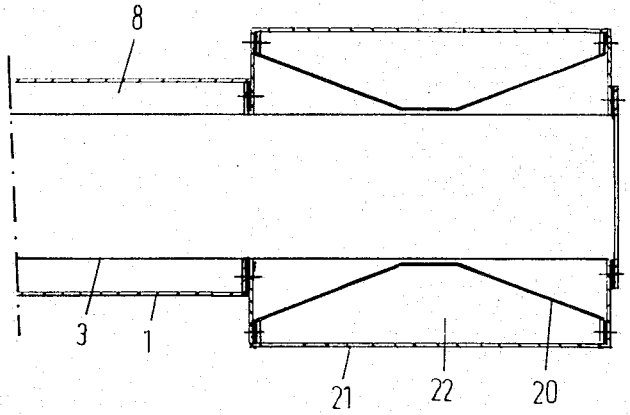
FIG. 8 shows a second modification.

Such an embodiment is diagrammatically shown in FIG. 8. A hose-like check device 20 is disposed in a housing 21 having a larger diameter than the housing 1 and surrounds the discharge end of the pump hose 3. Although check device 20 has a configuration similar to that of check device 11, it has a larger minimum cross-section than check device 11, in order to apply check device 20 around the hose 3. The check device 20 is attached to flanges formed in the housing 21 in the same manner as hose portions 11 and 11' are respectively attached to flanges formed in housing portions 12 and 12', while a hollow space 22 is provided between check device 20 and housing 21 to which a pressure medium can be supplied.

Figure 9:
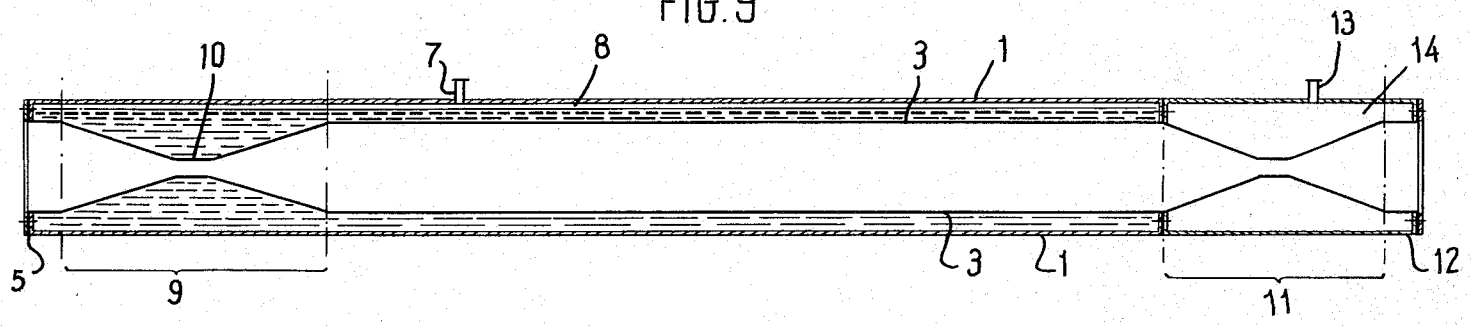
FIG. 9 shows a third modification.

According to a further embodiment of the invention, as shown in FIG. 9, at least the hollow space 8 is filled at least partly with a liquid of such a specific weight that buoyancy of the liquid compensates for the weight of the hose 3 as well as the weight of the pumpable material present in the hose. As a result the pump hose can have an unlimited length without its sagging, which could impede optimal operation of the pump. Another advantage of supplying a liquid in the hollow space is that little pressure need be supplied to squeeze the hose. Consequently, the pump can be operated more quickly, so that a larger capacity is obtained without varying the dimensions of the pump. At the same time less pressurized gas is required, so that the efficiency of the pump is improved.

Preferably, liquid glycerol is used. Liquid glycerol has a specific weight of 1.2 and its use is allowed to be used in the food industry.

It is observed that the modifications described in the original U.S. patent application 167,354, now U.S. Pat. No. 4,424,009, which have as their object to prevent the wall portions adjoining each other in the squeezed condition of the pump hose from adhering to each other, or to promote rapid opening of the pump hose, can also be used in the above described pump.

Such modifications, as well as the modifications shown in FIGS. 4, 5 and 11 of U.S. Pat. No. 4,424,009 or the modification wherein an additional hose is provided in the pump hose, are deemed to fall within the scope of the invention.

What I claim is:

1. A peristaltic pump comprising:

a pump housing having a supply end and a discharge end;

a pump hose having an outer wall, a supply end, and a discharge end and disposed within said pump housing, said supply and discharge ends of said pump hose being sealingly attached all around to said supply and discharge ends of said pump housing, respectively, said pump hose having a substantially circular cross-section at said supply end and a substantially elliptic cross-section over a portion thereof adjacent said supply end which, starting at said substantially circular cross-section, bcomes gradually flatter and broader to a given minimal value and subsequentially in the direction extending towards said discharge end of said pump hose becomes increasingly less flat and broad until the cross-section of said pump hose again becomes substantially circular, said pump hose having a substantially constant wall thickness along the entire length thereof between said supply end and said discharge end and a substantially constant inner cross-sectional circumference, and said pump hose and said pump housing defining a hollow space therebetween; and means provided in said pump housing for supplying a pressure medium to said hollow space and for discharging the pressure medium therefrom, whereby pressure is intermittently exerted on the outer wall of said pump hose.

2. The peristaltic pump of claim 1, further comprising:

a check housing and a check hose shorter than said pump hose disposed within said check housing and having a substantially elliptic cross-section over a portion thereof corresponding in shape to said substantially elliptic cross-section portion of said pump hose, said check hose and said check housing defining a hollow space therebetween to which a pressure medium can be supplied and said check hose being connected to said discharge end of said pump hose.

3. The peristaltic pump of claim 1, further comprising:

a check housing and a check hose shorter than said pump hose disposed within said check housing and having a substantially elliptic cross-section over a portion thereof corresponding in shape to said substantially elliptic cross-section portion of said pump hose and being oriented in the same direction as said substantially elliptic cross-section portion of said pump hose, said check hose having a larger minimum cross-section than said pump hose and being applied around said pump hose adjacent to the discharge end thereof.

4. The peristaltic pump of claim 2, said check hose further comprising a substantially conical transitional portion of substantially circular cross-section which smoothly connects with said discharge end of said pump hose, and said substantially elliptic cross-section portion of said check hose having smaller cross-sectional dimensions than said substantially elliptic cross-sectional portion of said pump hose.

5. The peristaltic pump of claim 2, 3, or 4, wherein said hollow space between said check hose and said check housing is filled once with a pre-compressed gas under a suitable pressure.

6. The peristaltic pump of claim 1, wherein said hollow space between said hose and said pump housing is filled at least partly with liquid.

7. The peristaltic pump of claim 6, wherein said liquid is glycerol.

8. The peristaltic pump of claim 2 or 4, wherein said pump hose and said check hose are made of one piece.

* * * * *